US006986425B2

(12) United States Patent
Paladin

(10) Patent No.: US 6,986,425 B2
(45) Date of Patent: Jan. 17, 2006

(54) APPARATUS AND METHOD TO SEPARATE ELEMENTS OR MATERIALS OF DIFFERENT SIZES

(75) Inventor: Romeo Paladin, Oderzo (IT)

(73) Assignee: Pal Srl, Ponte Di Piave (TV) (IT)

( * ) Notice: Subject to any disclaimer, the term of this patent is extended or adjusted under 35 U.S.C. 154(b) by 278 days.

(21) Appl. No.: 10/416,711

(22) PCT Filed: Feb. 8, 2002

(86) PCT No.: PCT/IB02/00376

§ 371 (c)(1),
(2), (4) Date: May 14, 2003

(87) PCT Pub. No.: WO02/062493

PCT Pub. Date: Aug. 15, 2002

(65) Prior Publication Data

US 2004/0069693 A1 Apr. 15, 2004

(30) Foreign Application Priority Data

Feb. 9, 2001 (IT) ..... UD2001A0022

(51) Int. Cl.
*B07B 13/00* (2006.01)

(52) U.S. Cl. ..... 209/671

(58) Field of Classification Search ..... 209/667–672, 209/678

See application file for complete search history.

(56) References Cited

U.S. PATENT DOCUMENTS

| | | | | |
|---|---|---|---|---|
| 513,089 | A * | 1/1894 | Crockett | 460/79 |
| 785,508 | A * | 3/1905 | Mason | 209/26 |
| 1,173,737 | A * | 2/1916 | Quesnell | 209/668 |
| 1,621,695 | A * | 3/1927 | Tuite et al. | 209/668 |
| 5,799,801 | A * | 9/1998 | Clark et al. | 209/667 |
| 6,149,018 | A | 11/2000 | Austin et al. | |
| 6,237,778 | B1 * | 5/2001 | Weston | 209/672 |
| 6,318,560 | B2 * | 11/2001 | Davis | 209/672 |

FOREIGN PATENT DOCUMENTS

| | | | |
|---|---|---|---|
| DE | 589557 | | 12/1933 |
| DE | 589557 | C * | 12/1933 |
| EP | 0382676 | | 8/1990 |
| EP | 0773070 | | 5/1997 |
| GB | 1511549 | | 5/1978 |
| NL | 1006582 | | 1/1999 |
| WO | 9840173 | | 9/1998 |
| WO | 9961173 | | 12/1999 |

* cited by examiner

*Primary Examiner*—Donald P. Walsh
*Assistant Examiner*—Joseph C. Rodriguez
(74) *Attorney, Agent, or Firm*—Stevens, Davis, Miller & Mosher, LLP

(57) ABSTRACT

Apparatus (10) and method to separate a loose mass formed by elements or materials (11) of different sizes, such as woody strands or wafers, comprising a separation chamber (13) into which the mass is inserted, a plurality of riddling rolls (16), mounted inside the chamber (13) rotating on axes of rotation parallel to each other and lying sybstantially on a same plane (X). Each of the riddling rolls (16) comprises a plurality of riddling elements (20), each of which is substantially square in shape, so as to form four cusps (22) in correspondence with the four tips of the square. The riddling elements (20) are adjacent to each other so that the cusps (22) form a plurality of grooves (24), and the riddling rolls (16) are axially staggered therebetween so that the cusps (22) of each roll (16) are constantly inserted, more or less deeply into the corresponding grooves (24) of the adjacent riddling roll (16), so as to define discharge apertures (25) with an alternated profile.

18 Claims, 6 Drawing Sheets

APPARATUS AND METHOD TO SEPARATE ELEMENTS OR MATERIALS OF DIFFERENT SIZES

FIELD OF THE INVENTION

The invention refers to an apparatus and a method to separate elements or materials of different sizes, such as for example wood chips or shavings, commonly known as strands or wafers, used in the production of OSB panels (Oriented Structural Boards or Oriented Strands Boards), pieces of paper or plastic material. In particular, the apparatus and method allow to screen or sort a mass of materials of different sizes, in order to separate the smaller pieces (the so-called fine or super-fine) from the bigger ones, without putting too much stress on the latter which, as they are so fragile, could easily be damaged or break.

BACKGROUND OF THE INVENTION

In order to screen elements or materials of different sizes, especially those of vegetable origin, such as wood or similar, it is known that the device described in the international patent application WO-A-98/40173, belonging to the same Applicant. This known device comprises a plurality of rolls, all rotating in the same direction, facing each other so that the cusps of each roll are inserted into the corresponding V-shaped grooves of the adjacent rolls, thus defining a zig-zag discharge profile. The rolls are also distanced laterally to define adjustable gaps between them, through which only those pieces which are equal to or smaller than the gaps can pass. Moreover, the connection surfaces between cusps and grooves are worked with protuberances, protrusions, hollows or faceted parts which allow to separate the pieces to be screened better.

Although this known device is very efficient for separating and sub-dividing relatively small pieces, that is to say, of a few millimetres, it is not suitable for separating materials which have large surfaces in proportion to their volume, as is the case with strands or wafers, which although they are relatively thin (about from 0.4 to 1.0 mm), have relatively large other dimensions: a length varying from about 60 mm to about 180 mm and a width varying from about 20 mm to about 80 mm. In fact, they tend to fall prevalently in horizontal layers, incorporating between them both smaller pieces (also called as micro-strands) and also very small pieces, such as slivers (called fine pieces) and also tiny pieces, such as saw dust (called super-fine pieces).

The state of the art also comprises other types of screening devices, such as those with a rotary drum, plane, oscillating or vibrating screens.

Rotary drum screens are not only very bulky, but also they have the problem of low specific efficiency since: only the lower surface is involved in the screening; the holes of the sieves are easily blocked; many long pieces, having however limited width, are erroneously discarded together with the fine pieces because they pass through the holes lying coaxial therewith. Rotary drum screens, moreover, do not allow to modify, simply and quickly, the value of the granulometry to be obtained, since this operation requires the sieves on the periphery of the drum to be completely replaced, and this takes a notoriously long time. The long time during which the strands remain inside the drum and their continuous mixing also generates further fine pieces.

Plane screens, whether oscillating or vibrating, are not able to separate the different layers of strands, which lie one on top of another in a sandwich, and which incorporate the fine materials inside them or retain them above.

DE-C-589557 discloses a screening device wherein a plurality of discs, having circular or elliptical form, are mounted on shafts disposed parallel therebetween and axially staggered, in order to define substantially constant discharge apertures between the opposed discs of two adjacent shafts.

U.S. Pat. No. 6,149,018 discloses an apparatus for sorting recycled material, which comprises a plurality of co-rotating spaced parallel shafts, each of which has a longitudinal series of screen discs. On each shaft the axial distance between the discs is rather high. Moreover each disc is shaped in order to have a constant discharge aperture with respect to the opposed disc during rotation of the shafts.

The present Applicant has devised the method and embodied the apparatus according to the invention to overcome the shortcomings of the state of the art, and to obtain further advantages which will be described hereafter.

SUMMARY OF THE INVENTION

The invention is set forth and characterized in the main claims, while the dependent claims describe other characteristics of the invention.

The purpose of the invention is to perfect a method and achieve an apparatus to separate and sort elements or materials of different sizes, particularly but not exclusively, pieces of wood such as strands or wafers, that is to say, substantially flat, so as to ensure on the one hand that the small size materials, the so-called fine or super-fine pieces, are separated from those of larger or regular size, before the whole mass to be sorted leaves the screening bed, and on the other hand that the larger size materials are not discarded together with the fine ones.

In accordance with this purpose, the apparatus according to the invention comprises a separation chamber into which the mass of material to be separated is able to be inserted, a plurality of riddling rolls mounted inside said separation chamber, rotating on axes of rotation parallel to each other and lying substantially on a same plane. According to one characteristic of the invention, each riddling roll comprises a plurality of riddling elements, each of which is substantially square in shape when shown on a plane perpendicular to the rotational axis of the corresponding riddling roll, so as to have four substantially rectilinear sides and to form four cusps at 90° with respect to each other, in correspondence with the respective tips. The riddling elements, adjacent to and suitably spaced from each other, define a plurality of grooves. Each riddling roll, moreover, is staggered axially with respect to the adjacent rolls, so that the cusps of the riddling elements of each roll are constantly inserted, more or less deeply, into the corresponding grooves of the adjacent riddling roll, so as to define discharge apertures with an alternated profile of peacks and valleys.

The lateral surfaces of the riddling elements can be coverging from the center to the periphery, whereby the resulting grooves have a zig-zag profile, or parallel therebetween, whereby the resulting grooves have a profile with right angles. In the first case, the gap between the riddling elements, that is, the distance between the lateral surfaces of the riddling elements of two adjacent rolls, has variable sizes between about 0.5 and 20 mm according to the interaxis between the riddling rolls, while in the second case the gap between the riddling elements has variable sizes between 1 and 10 mm. In any case, the gap can be selectively varied both within the plane of the riddling rolls, progressively increasing or decreasing, and for groups of rolls.

The cusps can be pointed with a sharp edge or can have the tips and crests joined or bevelled.

The riddling elements of each roll are mounted on a central shaft so that the riddling elements of one roll are staggered angularly with respect to the riddling elements of the adjacent roll.

The lateral surfaces can be advantageously provided with a plurality of irregular elements such as dips, hollows, protuberances, protrusions or faceted parts.

BRIEF DESCRIPTION OF THE DRAWINGS

These and other characteristics of the invention will be clear from the following description of a preferential form of embodiment, given as a non-restrictive example, with reference to the attached drawings wherein.

DETAILED DESCRIPTION OF PREFERRED EMBODIMENT

Figure 1:
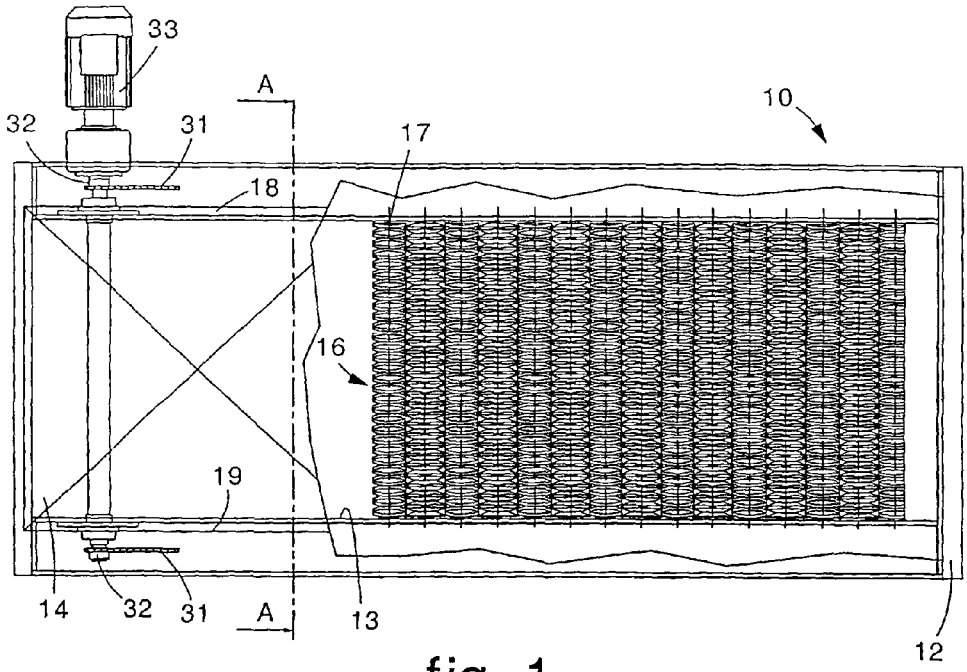
FIG. 1 is a plane view, partly sectioned, of an apparatus according to the invention.
Figure 2:
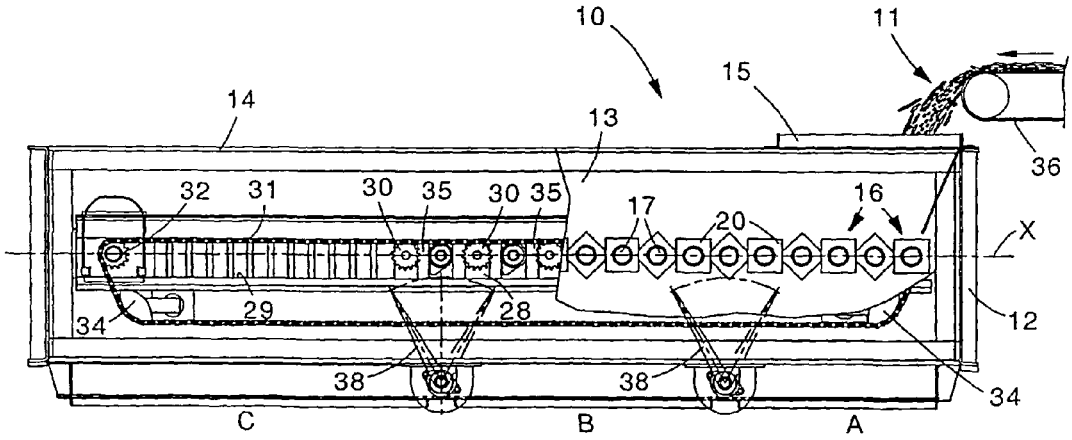
FIG. 2 is a side view, partly sectioned, of the apparatus shown in FIG. 1.

With reference to FIGS. 1 and 2, an apparatus 10 to separate elements or materials 11 of different sizes according to the invention comprises a metal bearing structure 12, substantially parallelepiped in shape, able to define a separation chamber 13, on one side of which, through a hopper-type mouth 15 a loose mass of material 11 is able to be introduced. This mass can advantageously consist of pieces of woody material, in the form of sheets or strands, mixed with micro-strands, and other fine and super-fine materials. The chamber 13 is closed at the top by a metal covering sheet 14 and is open at the bottom.

Inside the chamber 13 a plurality of riddling rolls 16 is arranged, mounted rotating on lateral walls 18 and 19 of the structure 12. The rolls 16 have the axes of rotation parallel to each other and lying substantially on a same plane X, so as to form a so-called riddling bed.

Figure 6:
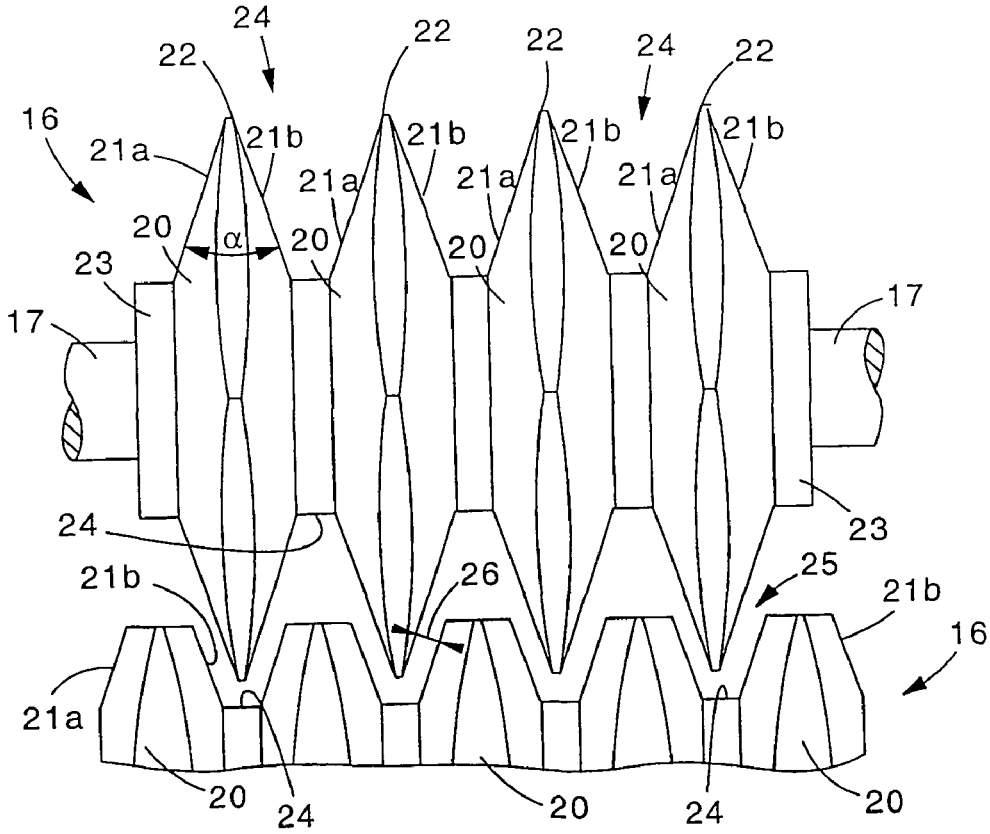
FIG. 6 is an enlarged detail of FIG. 1.

Each roll 16 (FIGS. 6 and 7) comprises a substantially cylindrical central shaft 17 on which a plurality of riddling elements 20, adjacent to each other, is mounted and keyed; advantageously, they are made of metal, rubber or synthetic material.

According to a characteristic feature of the invention, each element 20 is substantially square in shape, so as to have four rectilinear sides and to form cusps 22, disposed at 90° with respect to each other, in correspondence with the respective tips of the square.

Figure 6A:
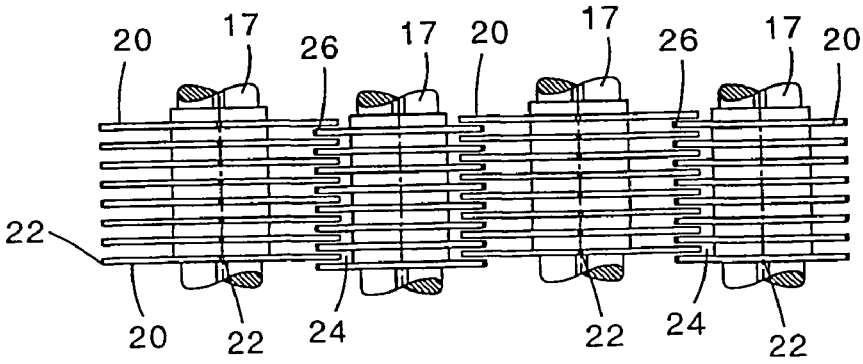
FIG. 6*a* is a plane view of an enlarged detail of a second variant of the apparatus shown in FIG. 1.

The lateral surfaces 21*a*, 21*b* or each riddling element can be either converging from the center towards the periphery as shown in FIGS. 1, 4, 5 and 6, or parallel therebetween, as shown in FIG. 6*a*.

Figure 7:
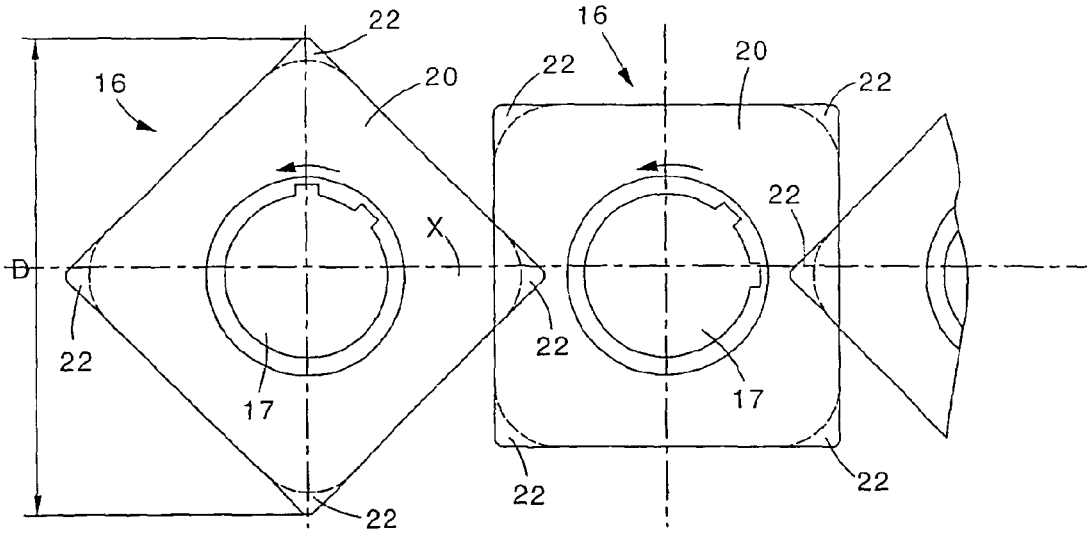
FIG. 7 is an enlarged detail of FIG. 2.

The cusps 22 can either have a sharp edge, as shown in the drawings, or, according to a variant shown by a line of dashes in FIG. 7, at least partly joined or rounded.

The transverse size D of each element 20 is advantageously between 130 and 250 mm.

The angle of inclination $\alpha$, formed by the lateral surfaces 21*a* and 21*b*, is comprised between 25° and 50°, advantageously between 35° and 40°.

The elements 20, adjacent to each other and possibly with spacer rings 23 between them, define a plurality of grooves 24, alternating with the cusps 22. The grooves 24 have a substantially V-shape when the lateral surfaces 21*a*, 21*b* are converging from the center towards the periphery, while have a substantially U-shape when the lateral surfaces 21*a*, 21*b* are parallel therebetween. The riddling elements 20 with lateral surfaces 21*a* and 21*b* parallel therebetween have a width comprised between about 2 and 6 mm.

Each riddling roll 16 is mounted so that the cusps 22 of the elements 20 of each roll 16 is constantly inserted, more or less deeply, into the corresponding grooves 24 of the adjacent roll 16, so as to define discharge apertures 25 having an alternated profile, i.e. a zig-zag profile (FIG. 6) or a right-angles profile (FIG. 6*a*). The discharge apertures 25, in particular, comprise gap 26 between the facing lateral surfaces 21*a*, 21*b*.

The minimum sizes of the discharge apertures 25 and the gaps 26 are variable according to the granulometry of the material which is to be discarded, that is, passed through the rolls 16.

The apparatus 10 according to the invention also allows to vary the discharge apertures 25 and the gaps 26, and to have them of different values even within the context of the same riddling bed, in a very simple manner, as will be explained hereafter. The value of the gap 26 is advantageously variable between 0.5 and 20 mm in the case shown in FIG. 6 and between 1 and 10 mm in the case shown in FIG. 6*a*.

Instead of being smooth, the lateral surfaces 21*a* and 21*b* of each element 20 are advantageously provided with a plurality of irregular elements 27, consisting of dips, hollows, protuberances, protrusions or faceted parts, as shown as an example in FIGS. from 8 to 13.

The rolls 16 are also mounted on the shafts 17 in such a manner that the elements 20 of each roll 16 are angularly staggered with respect to the elements 20 of the adjacent roll 16 (FIG. 7), so that the cusps 22 of the elements 20 of each roll 16 are in correspondence with one of the sides of the square of the facing element 20.

Figure 3:
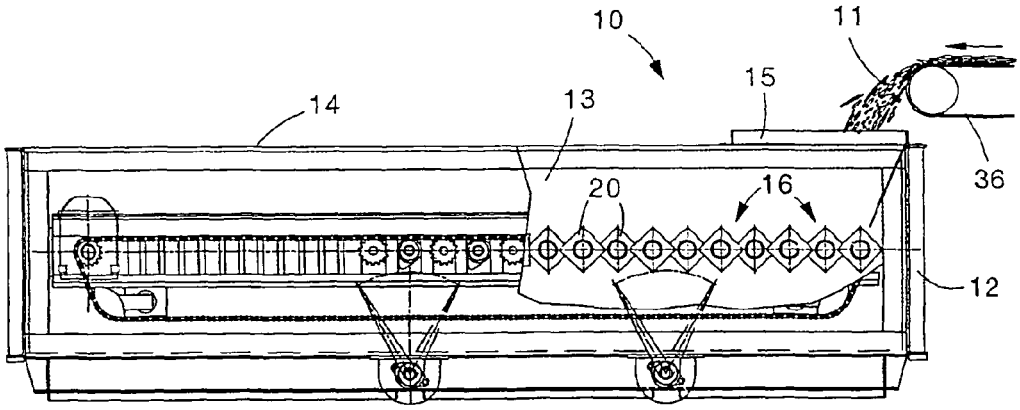
FIG. 3 is a side view, partly sectioned, of a first variant of the apparatus shown in FIG. 1.
Figure 4:
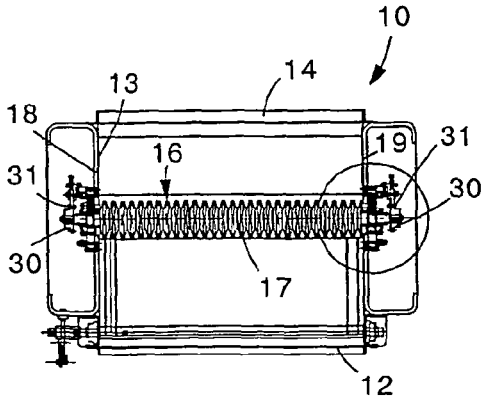
FIG. 4 is a cross section from A to A of FIG. 1.
Figure 5:
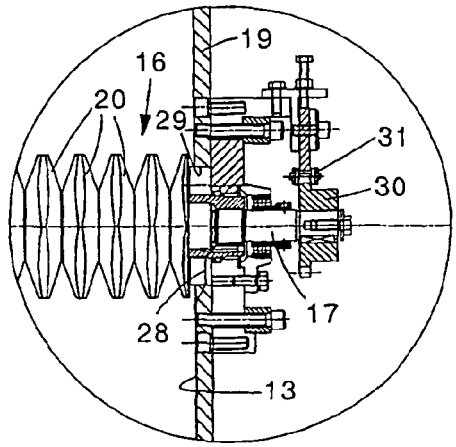
FIG. 5 is an enlarged detail of FIG. 4.
Figure 7A:
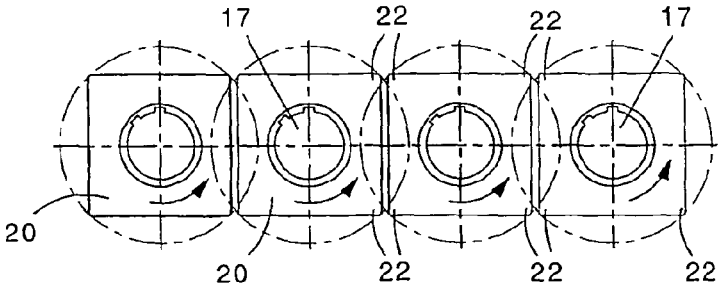
FIG. 7*a* is an enlarged detail of the first variant of FIG. 3.
Figure 8:
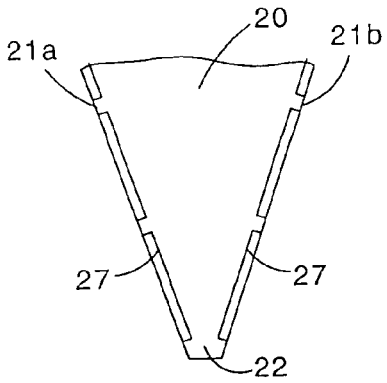
FIG. 8 is an enlarged detail of FIG. 6 which shows a first form of embodiment of the irregular elements 27.
Figure 9:
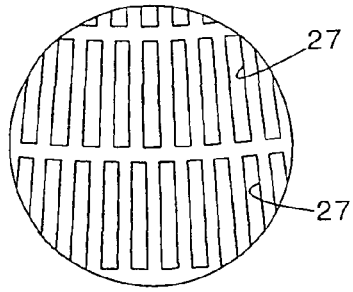
FIG. 9 is a side view of the detail in FIG. 8.
Figure 10:
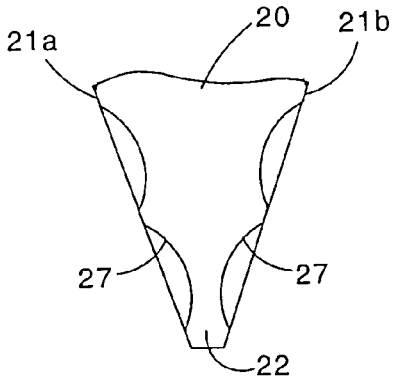
FIG. 10 is an enlarged detail of FIG. 6 which shows a second form of embodiment of the irregular elements 27.
Figure 11:
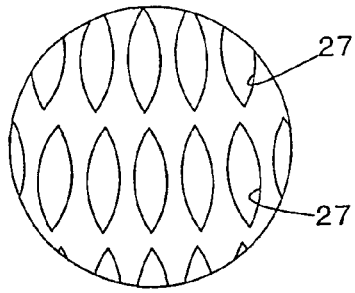
FIG. 11 is a side view of the detail in FIG. 10.
Figure 12:
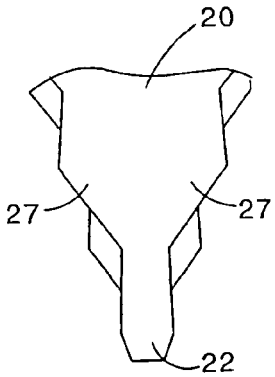
FIG. 12 is an enlarged detail of FIG. 6 which shows a third form of embodiment of the irregular elements 27.
Figure 13:
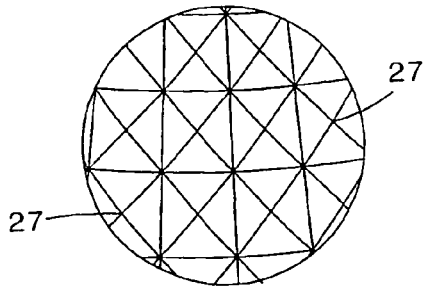
FIG. 13 is a side view of the detail in FIG. 12.

According to a variant shown in FIGS. 3 and 7*a*, the elements 20 of two adjacent rolls 16 are not angularly staggered, as mentioned above, so that the cusps 22 of the elements 20 of each roll 16 are always in correspondence with the cusps of the adjacent rolls 16.

The ends of the shafts 17 (FIGS. 2, 4 and 5) are mounted rotating on bearings or bushings 28, arranged sliding in guide slits 29 of the lateral walls 18 and 19.

At one end of each shaft 17, outside the chamber 13, a toothed wheel 30 is keyed. In particular, the toothed wheels 30 are arranged, alternately staggered, either on the side of the lateral wall 18 or on that of the lateral wall 19, so that two adjacent rolls 16 have the respective toothed wheels 30 arranged on opposite sides with respect to the structure 12.

Each row of toothed wheels 30 is constantly engaged with a distribution chain 31, made to rotate by a corresponding pinion 32 of a single electric motor 33 with the relative reduction unit.

The distribution chains 31 are both able to rotate in the same direction (anti-clockwise in FIG. 2), to make all the rolls 16 rotate in the same direction too.

Two pairs of elastic elements 34 (of which only one is shown in the drawings) are arranged inside the distribution chains 31 to keep them tense.

The distance between the rolls 16, and consequently the entity of the gaps 26, is defined by a plurality of spacer elements 35 mounted in removable manner in the slits 29 of the lateral walls 18 and 19. In order to vary a determined gap 26 between two adjacent rolls 16, it is sufficient to change the spacer elements 35 between said two rolls 16, without having to dismantle the same rolls 16 from the structure 12.

The apparatus 10 is able to be arranged with the mouth 15 in correspondence with one end of a conveyor belt 36, able to unload the material 11 to be sorted into the chamber 13.

Below the bed of rolls 16 one or more deflector elements 38 are arranged; they can be positioned angularly and are able to divide the bed into two or more selection zones. Thus, for example, a first deflector element 38 can be arranged a short distance from the mouth 15, to define a first selection zone A with the rolls 16 arranged relatively close together, to form gaps 26 of a few millimetres, advantageously from 0.5 to 5 mm, through which the so-called fine materials can pass. A second element 38 can be arranged in proximity with the last roll 16 (the one farthest to the left in FIG. 2), to define a second selection zone B with the rolls 16 arranged farther from each other, to form gaps 26 of several millimetres, advantageously from 5 to 10–20 mm, through which the so-called micro-strands can pass.

Between the last roll 16 of the riddling bed and the end of the chamber 13 opposite the mouth 15, a third selection zone C is defined, from which only the accepted pieces exit, that is to say, the pieces which have not passed through the discharge apertures 25, as for example the regular strands.

Figure 14:
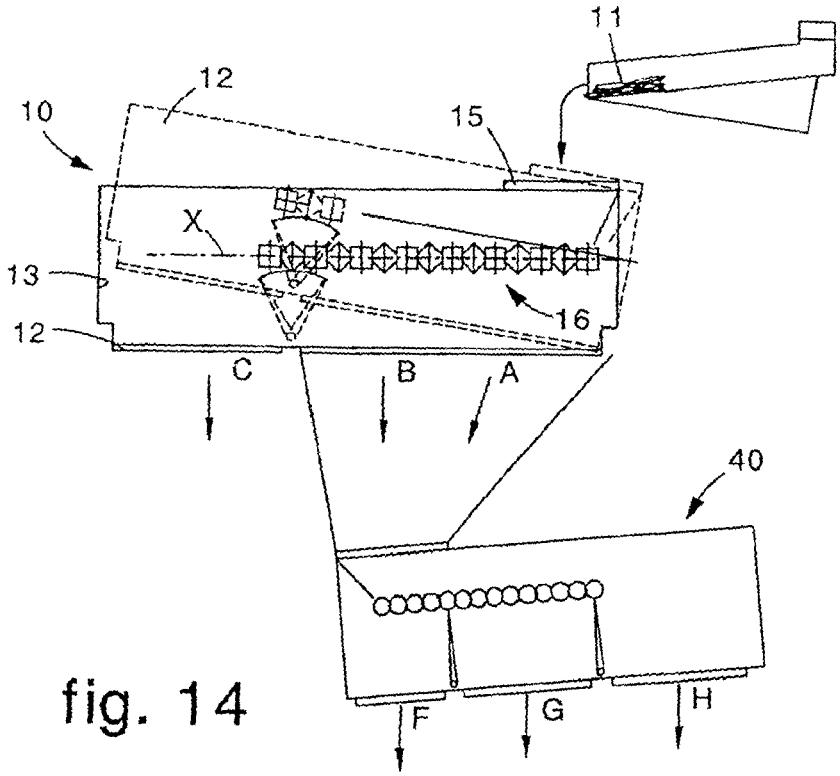
FIG. 14 is a side view of the apparatus shown in FIG. 1 in combination with a first separation apparatus of a conventional type.

The metal structure 12 (FIG. 14) can also be inclined up to about 40° with respect to the horizontal plane, in order to orientate upwards the plane X on which the axes of rotation of the rolls 16 lie, and to define an upwards travel of the material 11 introduced into the chamber 13.

The method to separate materials 11 of different sizes, by means of the apparatus 10 as described heretofore, comprises the following steps: the mass of materials 11 is introduced into the separation chamber 13, advantageously in correspondence with the first of the riddling rolls 16 (the one farthest to the right in FIG. 2); the material 11 introduced is made to advance towards the opposite side of the chamber 13, by means of simultaneous rotation in the same direction of the plurality of rolls 16, simultaneously causing the material 11 to jolt, in continuous and advantageously synchronous manner, in a direction orthogonal to the plane X on which the axes of rotation of the rolls 16 lie; the materials 11 discarded, that is, those with a size equal to or less than those defined by the discharge apertures 25, are removed from said discharge apertures 25, formed between the riddling elements 20; the materials of a greater size, that is, those separated from the others and accepted, are removed from a discharge zone C, located downstream of the bed of rolls 16.

According to one characteristic of the invention, the square shape of the riddling elements 20, combined with the constant mutual penetration of the cusps 22 into the grooves 24, and with the continuous rotation of the same elements 20, causes the jolting movement of the pieces which make up the material 11 to the point that they are detached from each other, even if they have a relatively large plane surface in proportion to their thickness, as in the case of strands. This makes the apparatus 10 extremely efficacious.

The apparatus 10 according to the invention is also able to be advantageously coupled with a conventional-type separation apparatus 40, for example of the type described in the afore-mentioned international patent application WO-A-98/40173.

The combination of the two apparatuses 10 and 40, with the first arranged above the second, allows to select the material 11 according to at least four granulometries: the whole of the material which passes between the gaps 26 of the rolls 16 of the apparatus 10 above, that is to say, the fine, super-fine and micro-strands, exiting from the zones A and B, goes to feed the apparatus 40 below, which provides to sub-divide them (super-fine in a zone F, fine in a zone G and micro-strands in a zone H). The regular strands continue to exit from the apparatus 10, through the zone C.

Figure 15:
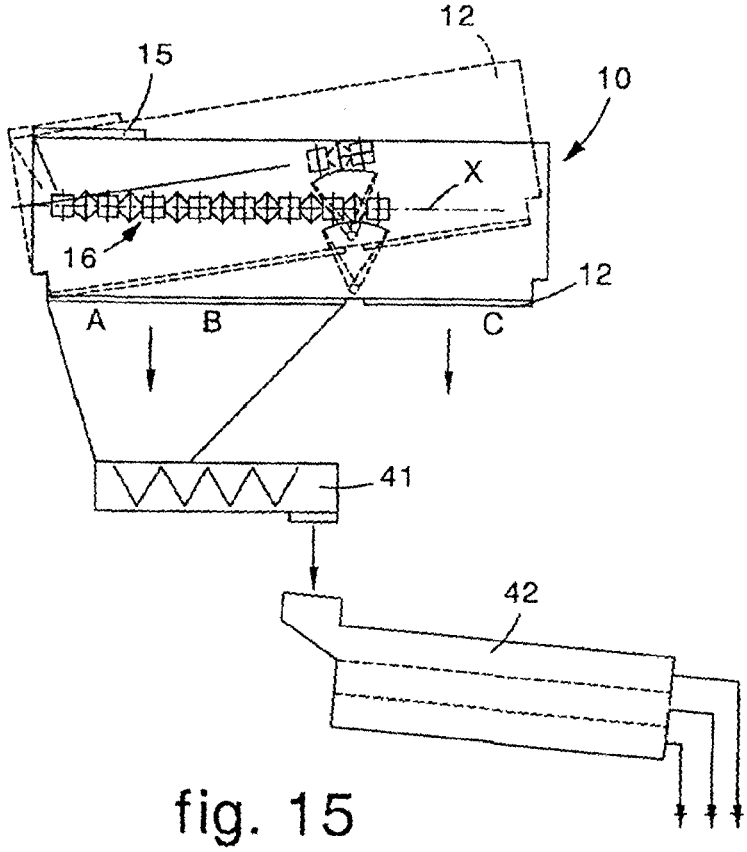
FIG. 15 is a side view of the apparatus shown in FIG. 1 in combination with a second separation apparatus of a conventional type.

According to a variant, shown in FIG. 15, the apparatus 10 can also advantageously be coupled with an underlying mechanical transporter 41, able to feed the material collected towards a conventional-type screen 42, either oscillating or vibrating.

It is clear that modifications or additions of parts or steps can be made to the apparatus 10 and the method to separate elements or materials 11 of different sizes, as described heretofore, without departing from the spirit and scope of the invention.

It is also clear that, although the invention has been described with reference to specific examples, a person of skill in the art shall certainly be able to achieve many other equivalent forms, all of which shall come within the field and scope of the invention.

The invention claimed is:

1. An apparatus for separating a loose mass formed by elements or materials of different sizes, comprising:

a separation chamber into which said mass is able to be inserted, a plurality of riddling rolls, mounted inside said chamber, rotating on axes of rotation parallel to each other and lying substantially on a same plane, wherein each of said riddling rolls comprises a central shaft and a plurality of riddling elements mounted on said central shaft, wherein each of said riddling elements is substantially square in shape, to form four cusps disposed at 90° with respect to each other, wherein said riddling elements are adjacent to each other so that said cusps form a plurality of grooves, wherein said riddling rolls are axially staggered therebetween so that the cusps of the riddling elements of each roll are able to be constantly inserted, during rotation of the riddling rolls, more or less deeply, into the corresponding grooves of the adjacent riddling roll, to define discharge apertures with an alternated profile, wherein said cusps are pointed with a substantially sharp, joined or rounded edge, and wherein the lateral surfaces of each of said riddling elements converge from said central shaft towards the periphery of said edge, wherein said grooves are substantially V-shaped and said alternated profile has a zig-zag shape.

2. The apparatus as in claim 1, wherein below said riddling rolls at least a deflector element is arranged, able to be positioned angularly and to divide said separation chamber into at least two selection zones.

3. The apparatus as in claim 1, wherein said separation chamber is able to be inclined up to about 40° with respect to the horizontal plane, to orientate upwards the plane on which the axes of rotation of said riddling rolls lie and define an upwards travel of said material.

4. The apparatus of claim 1, wherein the elements or materials of different sizes comprise large surfaces in proportion to their volume.

5. The apparatus as in claim 1, wherein said cusps have joined, beveled or rounded tips.

6. The apparatus as in claim 1, wherein the angle of inclination ($\alpha$) formed by said converging lateral surfaces is between 250° and 50°.

7. The apparatus as in claim 1, wherein the riddling elements of each of said rolls are mounted on said central shaft with spacer rings disposed therebetween.

8. The apparatus as in claim 7, wherein said riddling elements are mounted on said shafts to angularly stagger the riddling elements of each of said rolls with respect to the riddling elements of the adjacent roll so the cusps of the riddling elements of each roll are in correspondence with one of the sides of the square of the facing riddling element.

9. The apparatus as in claim 1, wherein said discharge apertures and the gaps have variable sizes according to the interaxis between said riddling rolls.

10. The apparatus as in claim 1, wherein said gaps are variable between about 0.5 and 20 mm.

11. The apparatus as in claim 1, wherein said lateral surfaces are provided with a plurality of irregular elements, consisting of dips, hollows, protuberances, protrusions or faceted parts.

12. The apparatus of claim 1, wherein the elements or materials of different sizes comprise woody strands or wafers.

13. An apparatus for separating a loose mass formed by elements or materials of different sizes, comprising:

a separation chamber into which said mass is able to be inserted, a plurality of riddling rolls, mounted inside said chamber, rotating on axes of rotation parallel to each other and lying substantially on a same plane, wherein each of said riddling rolls comprises a plurality of riddling elements, wherein each of said riddling elements is substantially square in shape, to form four cusps disposed at 90° with respect to each other, wherein said riddling elements are adjacent to each other so that said cusps form a plurality of grooves, wherein said riddling rolls are axially staggered therebetween so that the cusps of the riddling elements of each roll are able to be constantly inserted, during rotation of the riddling rolls, more or less deeply, into the corresponding grooves of the adjacent riddling roll, to define discharge apertures with an alternated profile, wherein the riddling elements of each of said rolls are mounted on a central shaft, adjacent to each other, wherein the ends of said central shafts are mounted rotating on guide means arranged sliding in grooved guides of two lateral walls of said separation chamber, wherein at one end of each shaft, outside said separation chamber, a toothed wheel is keyed, engaged with a distribution chain, made to rotate by a corresponding drive member, and wherein said toothed wheels are arranged, alternately staggered, on opposite sides with respect to said separation chamber, each row of toothed wheels being constantly associated with a corresponding distribution chain commanded by said drive member.

14. An apparatus for separating a loose mass formed by elements or materials of different sizes, comprising:

a separation chamber into which said mass is able to be inserted, a plurality of riddling rolls, mounted inside said chamber, rotating on axes of rotation parallel to each other and lying substantially on a same plane;

wherein each of said riddling rolls comprises a plurality of riddling elements, wherein each of said riddling elements is substantially square in shape, to form four cusps disposed at 90° with respect to each other, wherein said riddling elements are adjacent to each other so that said cusps form a plurality of grooves, wherein said riddling rolls are axially staggered therebetween so that the cusps of the riddling elements of each roll are able to be constantly inserted, during rotation of the riddling rolls, more or less deeply, into the corresponding grooves of the adjacent riddling roll, to define discharge apertures with an alternated profile, wherein the riddling elements of each of said rolls are mounted on a central shaft, adjacent to each other, wherein the ends of said central shafts are mounted rotating on guide means arranged sliding in grooved guides of two lateral walls of said separation chamber, wherein at one end of each shaft, outside said separation chamber, a toothed wheel is keyed, engaged with a distribution chain, made to rotate by a corresponding drive member, and wherein the distance between said riddling rolls, and consequently the entity of said discharge apertures, is defined by a plurality of spacer elements mounted in removable manner in said grooved guides of said lateral walls.

15. The apparatus for separating a loose mass formed by elements or materials of different sizes, comprising:

a separation chamber into which said mass is able to be inserted, a plurality of riddling rolls, mounted inside said chamber, rotating on axes of rotation parallel to each other and lying substantially on a same plane, wherein each of said riddling rolls comprises a central shaft and a plurality of riddling elements mounted adjacent to each other on said central shaft, wherein each of said riddling elements is substantially square in shape, to form four cusps disposed at 90° with respect to each other, wherein said riddling elements are adjacent to each other so that said cusps form a plurality of grooves, wherein said riddling rolls are axially staggered therebetween so that the cusps of the riddling elements of each roll are able to be constantly inserted, during rotation of the riddling rolls, more or less deeply, into the corresponding grooves of the adjacent riddling roll, to define discharge apertures with an alternated profile, wherein the ends of said central shafts are mounted rotating on guide means arranged sliding in guide slits of two lateral walls of said separation chamber, wherein said guide slits are substantially parallel to said plane, and wherein at one end of each shaft, outside said separation chamber, a toothed wheel is keyed, engaged with a distribution chain, made to rotate by a corresponding drive member.

16. A method for separating a loose mass formed by elements or materials of different sizes, comprising:

inserting said mass of material in proximity with one side of a separation chamber in which a plurality of riddling rolls is rotatably mounted with their axes of rotation parallel to each other and lying substantially on a same plane, wherein:

each of said riddling rolls is achieved by means of a plurality of riddling elements, mounted adjacent to each other on a central shaft, wherein each of said riddling elements is substantially square in shape, to form four cusps disposed at 90° with respect to each other, said adjacent riddling elements thus forming a plurality of grooves;

each of said riddling rolls is mounted so that the cusps of the relative riddling elements are constantly inserted, during rotation of the riddling rolls, more or less deeply, into the corresponding grooves of the adjacent riddling roll, to define discharge apertures with an alternated profile, wherein said cusps are pointed with a substantially sharp edge, and wherein the lateral surfaces of each of said riddling elements converge from said central shaft towards the periphery of said substantially sharp edge, wherein said grooves are substantially V-shaped and said alternated profile has a zig-zag shape;

the inserted material is made to advance towards the opposite side of said separation chamber by means of simultaneous rotation in the same direction of said plurality of riddling rolls, also simultaneously causing the material to jolt, in a direction substantially orthogonal to said plane;

removing the discarded materials from said discharge apertures;

removing the accepted materials from a discharge zone, located downstream of said riddling rolls.

17. The method of claim 16, wherein the elements or materials of different sizes comprise large surfaces in proportion to their volume.

18. The method of claim 16, wherein the elements or materials of different sizes comprise woody strands or wafers.

* * * * *